US009304476B2

(12) United States Patent
Nakashima et al.

(10) Patent No.: US 9,304,476 B2
(45) Date of Patent: Apr. 5, 2016

(54) IMAGE FORMING APPARATUS

(71) Applicant: CANON KABUSHIKI KAISHA, Tokyo (JP)

(72) Inventors: Yusuke Nakashima, Yokohama (JP); Atsuhiko Yamaguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/541,657

(22) Filed: Nov. 14, 2014

(65) Prior Publication Data

US 2015/0139672 A1 May 21, 2015

(30) Foreign Application Priority Data

Nov. 18, 2013 (JP) ..... 2013-237910

(51) Int. Cl.
*G03G 15/20* (2006.01)
*G03G 15/00* (2006.01)

(52) U.S. Cl.
CPC ..... *G03G 15/80* (2013.01); *G03G 15/2039* (2013.01); *G03G 2215/2035* (2013.01)

(58) Field of Classification Search
CPC ..... G03G 15/80; G03G 15/2039; G03G 15/2078; G03G 2215/2035
See application file for complete search history.

(56) References Cited

U.S. PATENT DOCUMENTS

| | | | | |
|---|---|---|---|---|
| 8,610,315 | B2 | 12/2013 | Ushiro | |
| 2006/0051111 | A1* | 3/2006 | Kishi et al. | 399/33 |
| 2009/0034142 | A1 | 2/2009 | Ushiro | |
| 2013/0108306 | A1 | 5/2013 | Saito et al. | |
| 2013/0195479 | A1 | 8/2013 | Tsujihara et al. | |
| 2013/0336672 | A1 | 12/2013 | Mizuta et al. | |

FOREIGN PATENT DOCUMENTS

| | | | |
|---|---|---|---|
| JP | 2009-36915 | A | 2/2009 |
| JP | 2011-128299 | A | 6/2011 |
| JP | 2012-42573 | A | 3/2012 |
| JP | 2013-157202 | A | 8/2013 |

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image forming apparatus includes a fixing portion for heating and fixing an unfixed image formed on a recording material, the fixing portion including a cylindrical film, a heater provided in an inside space of the film, a switch portion actuatable by heat from the heater, and a protection element for shutting off electric power supplied to the heater; a DC voltage source for generating a DC voltage from a commercial AC voltage source. The protection element is connected in a DC circuit operable by the DC voltage source, and when the switch portion is rendered off, the electric power supply to the heater is shut off.

25 Claims, 10 Drawing Sheets

IMAGE FORMING APPARATUS

FIELD OF THE INVENTION AND RELATED ART

The present invention relates to an image forming apparatus such as an electrophotographic copying machine, an electrophotographic printer, and the like.

One of the known fixing apparatuses (fixing devices) to be mounted in an electrophotographic printer, a copying machine, and the like, is a fixing device of the so-called film-heating type. A fixing device of this type has: a heater consisting of a ceramic substrate, and a heat generating layer, which is disposed on the ceramic substrate and generates heat as electric current flows therethrough. The device also has a cylindrical film which moves in contact with the heater, and a pressure roller which forms a nip between itself and the heater, with the presence of the film between itself and heater. A sheet of a recording medium, on which an unfixed toner image is present, is heated while it is conveyed through the nip, remaining pinched by the film and the pressure roller, whereby the toner image on the sheet of the recording medium is thermally fixed to the sheet.

The fixing device of this type has a merit in that the length of time it requires for its temperature to rise to a temperature range in which satisfactory fixation is possible, after its heater begins to be supplied with electric power. Thus, a printer having a fixing device of this type can reduce the length of time (FPOT: First Print Output Time) it takes for the printer to output the first image after the inputting of a print start command. Further, a fixing device of this type has also a merit in that it consumes a small amount of power while it is kept on standby, waiting for a print command.

A fixing device of the above-described type is provided with a temperature detection element, such as a thermistor, for detecting the temperature of its heater. It is also provided with a protection element such as a thermal switch and a thermal fuse which blocks the electric power supply to the heater from a commercial AC power supply, if the heater generates an abnormal amount of heat when the temperature detection element malfunctions or the like incident occurs.

Generally speaking, a protection element is serially disposed between a commercial AC power source and the heater as disclosed in Japanese Laid-open Patent Application 2011-128299. Further, a protection element is disposed in contact with the heater.

In a case where the protection element of a fixing device of the so-called film heating type is disposed in contact with the heater, the electric wire which connects the protection element to the commercial AC power source has to be disposed, with the protection element, in the film unit of the fixing device, which includes the heater, and the cylindrical film, which rotates, while remaining in contact with the heater.

The electric wire for AC current is relatively large in diameter, resulting in its use being problematic in that its use makes it difficult to reduce the size of the film unit.

SUMMARY OF THE INVENTION

According to an aspect of the present invention, there is provided an image forming apparatus comprising a fixing portion for heating and fixing an unfixed image formed on a recording material. The fixing portion includes a cylindrical film, a heater provided inside the cylindrically-shaped film, a switch portion actuatable by heat from the heater, and a protection element for shutting off electric power supplied to the heater, and a DC voltage source for generating a DC voltage from commercial AC voltage source. The protection element is disposed inside the cylindrically-shaped film and is connected in a DC circuit operable by the DC voltage source. When the switch portion is rendered off, the electric power supply to the heater is shut off.

Further features of the present invention will become apparent from the following description of exemplary embodiments with reference to the attached drawings.

DESCRIPTION OF THE PREFERRED EMBODIMENTS

Hereinafter, some of preferred embodiments of the present invention are described with reference to appended drawings. Although the following preferred embodiments of the present invention are the most preferable ones, they are not intended to limit the present invention in scope. That is, the present invention is applicable to various fixing devices which are different in structure from those in the following embodiments, within the scope of the present invention.

Embodiment 1

(1) Image Forming Apparatus

Figure 1:
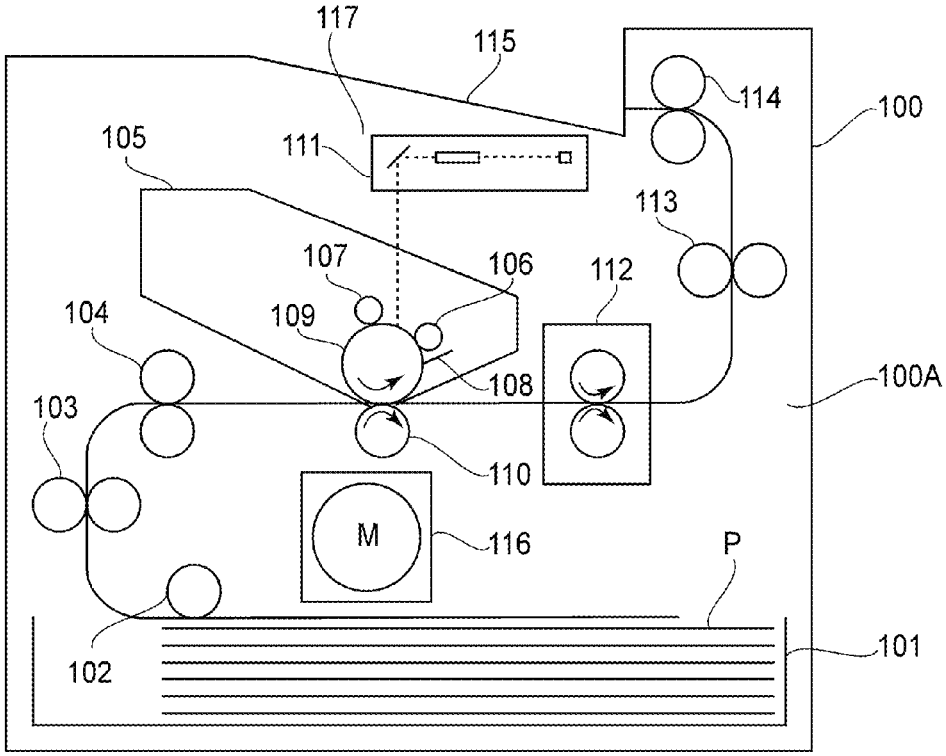
FIG. 1 is a sectional view of the image forming apparatus in the first embodiment of the present invention, and shows the general structure of the apparatus.

First, referring to FIG. 1, a typical image forming apparatus, to which the present invention is applicable, is described. FIG. 1 is a sectional view of an image forming apparatus 100 (which in this embodiment is monochromatic printer) based on electrophotographic image formation technologies. It shows the general structure of the image forming apparatus 100.

The image formation section 117 of the image forming apparatus 100, which is for forming a toner image on a sheet P of the recording medium, has a photosensitive drum 109 as an image bearing member, a charging member 106, and a laser scanner 111. The image formation section 117 has also a developing device 107, and a cleaner 108 for cleaning the peripheral surface (surface) of the photosensitive drum 109, and a transferring member 110. The photosensitive drum 109, the charging member 106, the developing device 107, and the cleaner 108 are integrated in the form of a cartridge 105 which is removably installable in the main assembly 100A of the image forming apparatus 100. The operation of the above-described image formation section 117 has been well known. Here, therefore, it is not described in detail.

Sheets P of the recording medium stored in a cassette 101 in the main assembly 100A of the image forming apparatus 100 are moved out of the cassette 101, one by one, by the rotation of a roller 102. Then, each sheet P of the recording medium is conveyed by the rotation of a pair of rollers 103 to a pair of rollers 104. Then, it is conveyed by the rotation of the rollers 104 to the transfer section formed by the transferring member 110 and the photosensitive drum 109. After the transfer of an unfixed toner image to the sheet P of the recording medium in the transfer section, the sheet P is sent to a fixing device (fixing section) 112, in which the unfixed toner image is thermally fixed to the sheet P. After the sheet P is moved out of the fixing device 112, it is discharged onto a tray 115 by the rotation of rollers 113 and 114.

A reference numeral 116 denotes a motor, which is for providing the image forming apparatus 100 with the force for driving the above-described rollers 102, 103 104, 113, and 114 and also, the force for driving the image formation section 117 and the fixing device 112.

(2) Fixing Device (Image Heating Device) 112

(2-1) General Structure of Fixing Device

Figure 2:
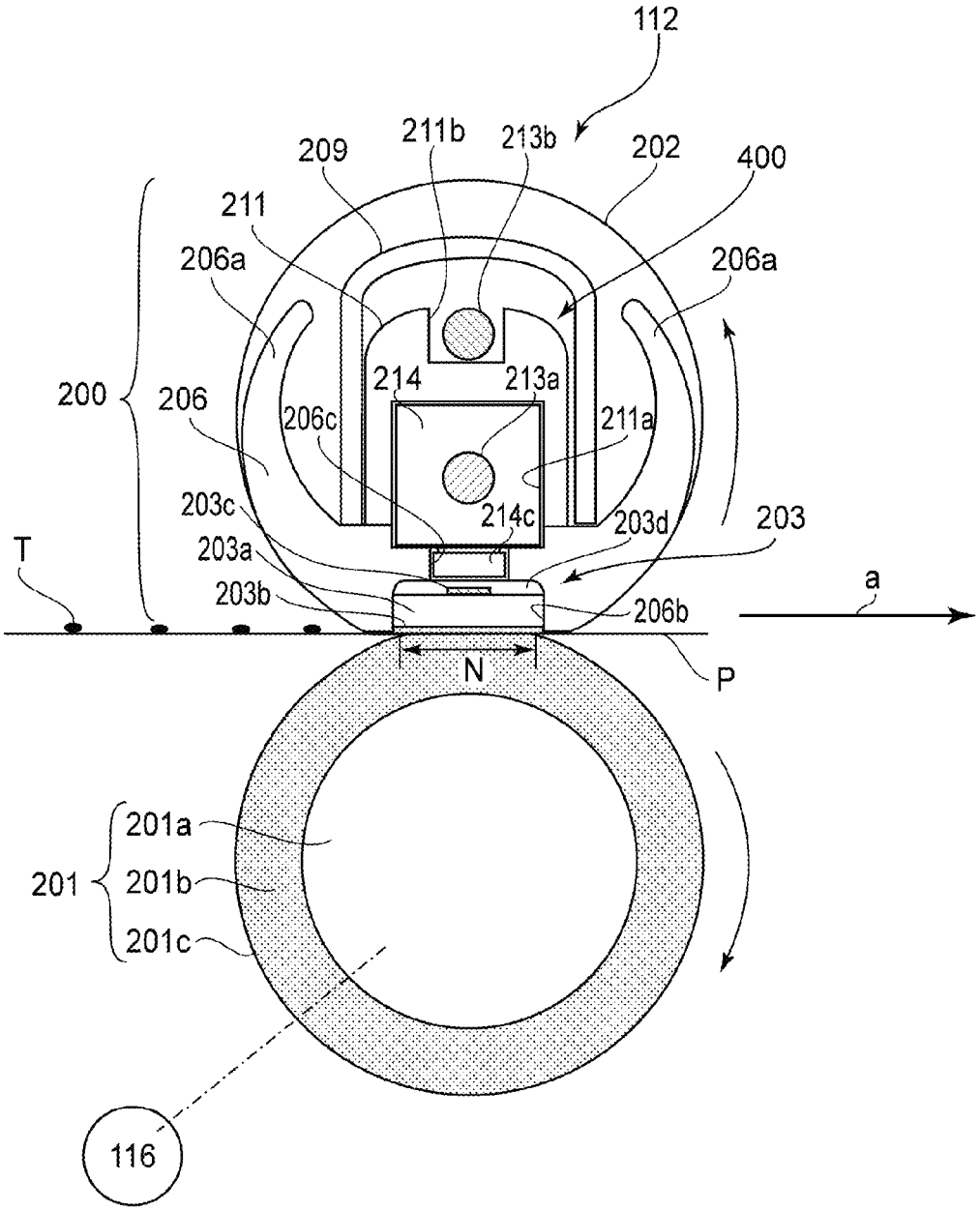
FIG. 2 is a sectional view of the fixing device in the first embodiment, and shows the general structure of the device.
Figure 3:
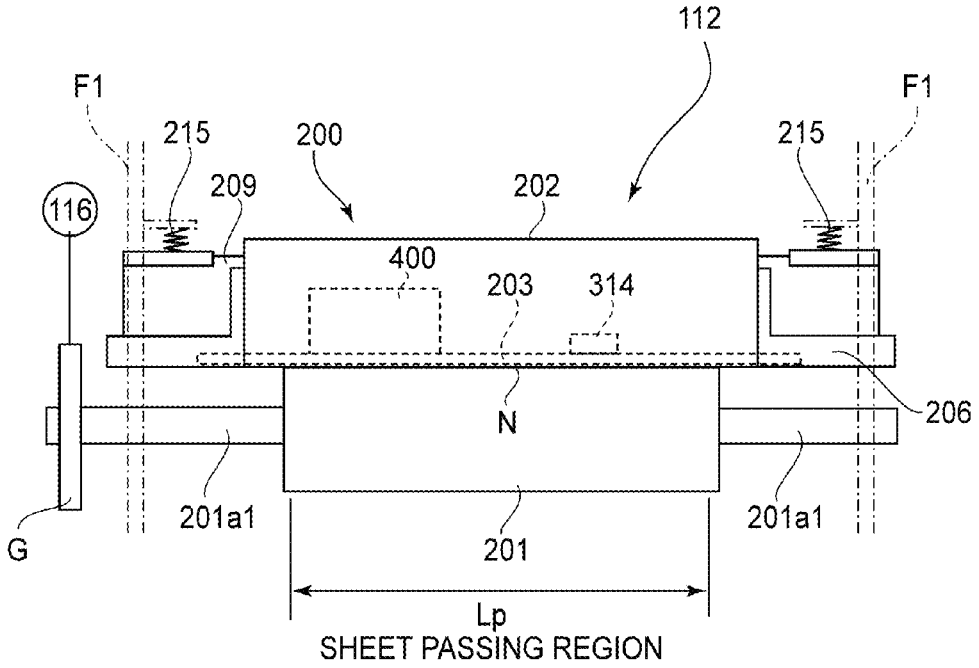
FIG. 3 is a front view of the fixing device in the first embodiment, as seen from the upstream side of the device in terms of the recording medium conveyance direction, and shows the general structure of the device.

FIG. 2 is a sectional view of the fixing device 112. It shows the general structure of the fixing device 112. This fixing device 112 is of the so-called film heating type. FIG. 3 is a plan view of the fixing device 112 as seen from the upstream side of the device 112 in terms of the recording-medium conveyance direction. It also shows the general structure of the device 112.

The fixing device 112 in this embodiment has a film unit 200, and a pressure roller 201 as a pressure applying member. The film unit 200 has a cylindrical film (rotational member) 202. A ceramic heater 203, which will be described later, is supported by a heater holder (supporting member) 206, in the hollow of the heater holder 206. More concretely, the ceramic heater 203 (which hereafter will be referred to simply as the "heater") is disposed within the film unit 200 (within heating unit). Referring to FIG. 2, a reference numeral 209 denotes a metallic stay as a reinforcing member. A reference numeral 314 denotes a thermistor as a temperature detecting member. Further, a reference numeral 400 denotes a protection unit.

Each of the pressure roller 201, the film 202, the heater holder 206, and the stay 209 is a long and narrow component, the lengthwise direction of which is perpendicular to the recording-medium conveyance direction a (which hereafter will be referred to simply as the lengthwise direction), that is, the direction in which the recording medium is conveyed through the aforementioned nip.

The film 202 is flexible and heat resistant. The base layer of the film 202 may be formed of resin, such as polyamide, or a metallic substance, such as stainless steel. The film 202 may be laminar, being made up of a base layer and a rubber layer. It is desired that the film 202 is also provided with a parting layer, which is to be formed, as a surface layer, of fluorinated resin or the like.

The holder 206 is heat resistant and thermally insulative. It has a pair of guiding portions 206*a*, which are arc-shaped in cross-section and are on the upstream and downstream sides, one for one, of the nip N, in terms of the direction (which hereafter will be referred to as "widthwise direction") parallel to the recording-material conveyance direction a. The fixing device 112 is structured so that as the film 202 is rotated, the film 202 is guided by the guiding portions 206*a*. Further, the heater holder 206 supports the heater 203; the heater 203 is held in a groove 206*b*, with which the flat surface of the holder 206, which is on the pressure roller side, is provided. The groove 206*b* extends in the lengthwise direction of the heater holder 206. The film 202 is loosely fitted around the heater holder 206 by which the heater 203 is held.

The heater 203 has a ceramic substrate 203*a*, which is long and narrow. The inward surface of the heater substrate 203*a*, on which the inward surface of the film 202 slides, is provided with low-friction layer 203*b*, which comes into contact with the inward surface of the film 202. As the material for the low-friction layer 203*b*, glass or the like substance is used. The opposite surface of the heater substrate 203*a* from the surface, on which the film 202 slides, that is, the surface of the heater substrate 203*a*, on which the film 202 does not slide, is provided with a layer 203 *c* of a heat generating resistor, which generates heat as electric current flows through the layer 203*c*. The heat generating resistor layer 203*c* extends in the lengthwise direction of the heater substrate 203*a*. It is formed by printing. The surface of the heat generating layer 203*c* is covered with an electrically insulative layer 203*d*, which is formed of glass or the like substance.

The thermistor 314, which is a temperature detecting member, is in contact with the surface of the electrically insulative layer 203*d* of the heater 203 (FIG. 2). The holder 206 is provided with a hole (unshown), which is within a recording-medium passage Lp of the nip N, which will be described later, in terms of the lengthwise direction. The holder 206 supports the thermistor 314 in such a manner that the thermistor 314 contacts the surface of the electrically insulative layer 203*d* of the heater 203.

The stay 209 is rigid, and is U-shaped in cross section. It is disposed on the holder 206, between the pair of guiding portions 206*a* of the holder 206, which are arc-shaped in cross section. It extends in the lengthwise direction.

The pressure roller 201 has a metallic core 201*a* formed of aluminum, iron, stainless steel, or the like, and an elastic layer 201*b* formed of a heat resistant elastic substance such as silicone rubber, on the peripheral surface of the metallic core 201*a*, between the shaft portions 201*a*1 and 201*a*2 (FIG. 3), which are the lengthwise end portions of the metallic core 201*a*. It has also a parting layer 201*c* formed of fluorinated resin or the like, on the outward surface of the elastic layer 201*b*.

Referring to FIG. 3, the fixing device 112 in this embodiment is structured so that the lengthwise end portions of the holder 206 are supported by the left and right lateral plates F1 of the fixing device 112, and also, so that the shaft portions 201*a*1 of the metallic core 201*a* of its pressure roller 201 are rotatably supported by the left and right lateral plates F1. Further, the lengthwise end portions of the stay 209 are kept pressured by a pair of compression springs 215 in the direction perpendicular to the generatrix of the film 202, to keep the heater 203 pressed against the pressure roller 201, with the presence of the film 202 between the heater 203 and the pressure roller 201. Thus, the elastic layer 201*b* of the pressure roller 201 is elastically deformed, creating the nip N, which has a preset width, between the surface of the film 202 and the surface of the pressure roller 201.

In terms of the lengthwise direction of the nip N, the protection unit 400 is disposed within the recording-medium passage Lp. This protection unit 400 has a protection element 214, which prevents the temperature of the heater 203 from exceeding a preset level, which is higher than a fixation level (target level), and a holder 211 as a member for supporting this protection element 214. The protection element 214 is a thermal switch or a thermal fuse. It is an element that has an internal switching portion. The holder 211 is similar in structure to the thermostat holder disclosed in the aforementioned Japanese Laid-open Patent Application 2011-128299, and supports the protection element 214. Next, the structure of the holder 211 is briefly described.

Referring to FIG. 2, the holder 211 holds the protection element 214, in a recess 211*a* with which the bottom surface of the holder 211, which is on the heater side, is provided. The protection element 214 held by the holder 211 is pressed upon the surface of the electrically insulative layer 203*d* of the heater 203, through a hole 206*c* with which the heater holder 206 is provided (FIG. 2). That is, the protection element 214 is on the inward side of the cylindrical film 202. Further, the holder 211 supports the electric wire 213*b* for the protection element 214 by a recess 211*b*, with which the opposite (back) surface of the holder 211 from the heater 203 is provided.

Next, referring to FIGS. 2 and 3, the thermistor 314 is pressed upon the electrically insulative layer 203*d* of the heater 203, through the hole (unshown) with which the holder 206 is provided, on the inward side of the recording-medium passage Lp, in terms of the lengthwise direction of the nip N. It detects the temperature of the heater 203. That is, the thermistor 314 is disposed on the inward side of the cylindrical film 202.

(2-2) Structure of Heater Driving Circuit

Figure 4A:
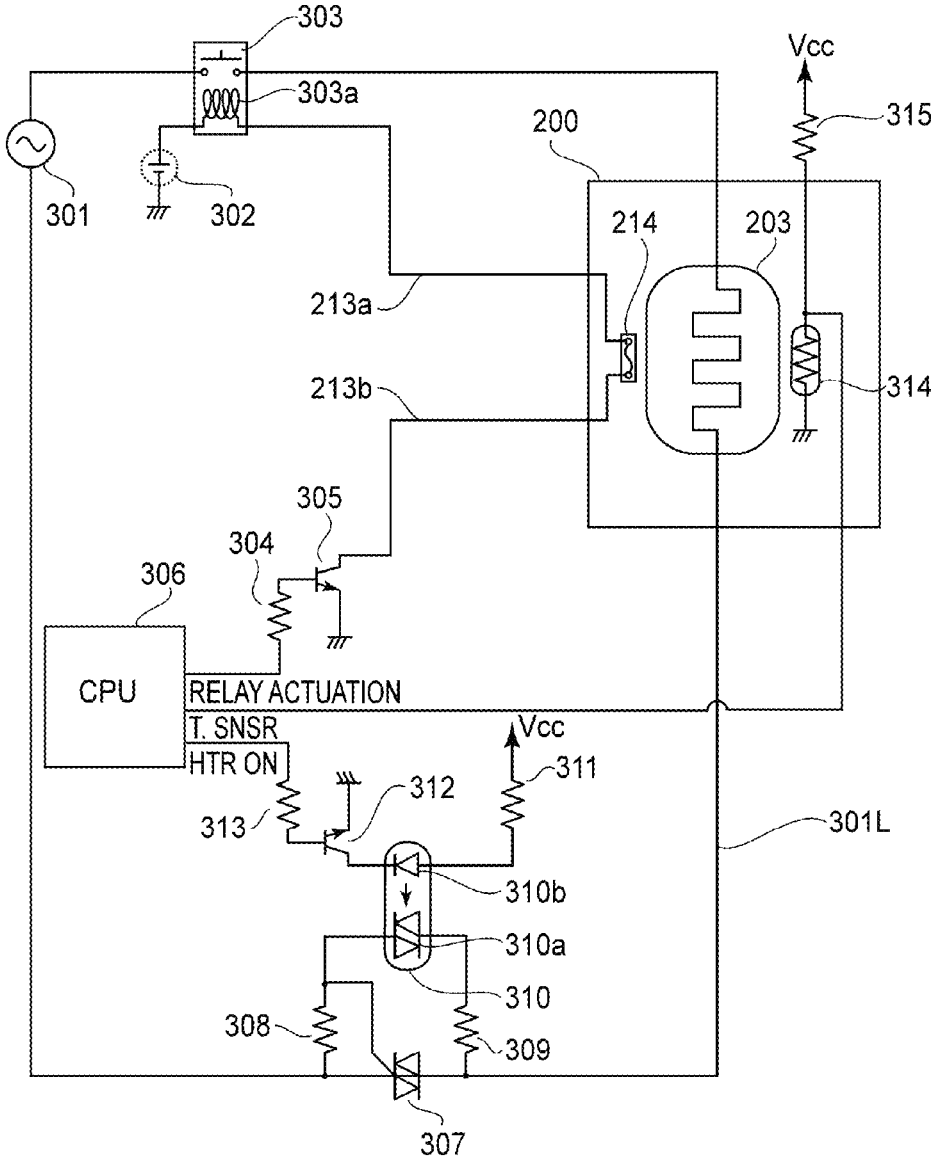
FIGS. 4A and 4B illustrate the heater driving circuit of the fixing device in the first embodiment.
Figure 4B:
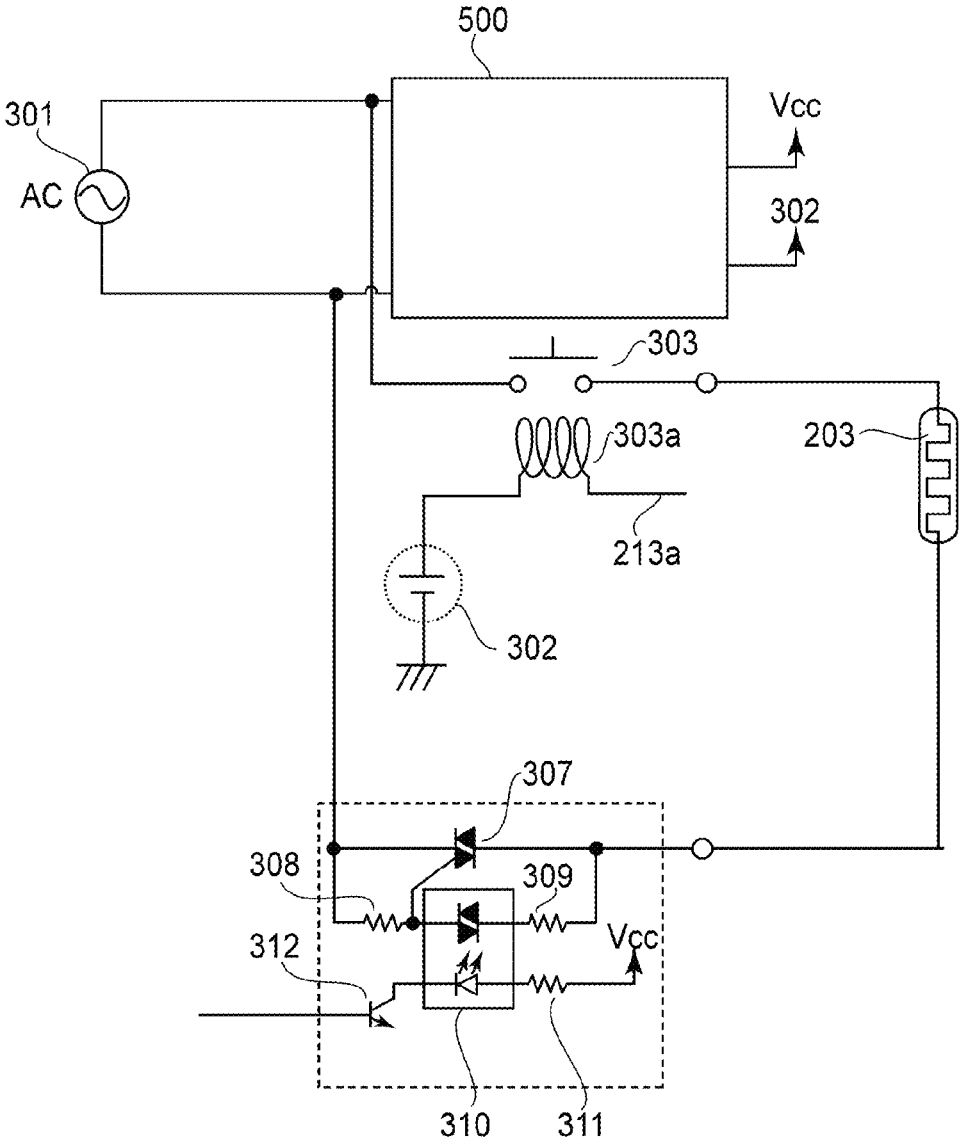

FIGS. 4A and 4B show the structure of the heater driving circuit of the fixing device 112 in this embodiment. The heater driving circuit is structured so that it causes the heater 203 to generate heat, by supplying the heater 203 with electric power through a relay 303 as a blocking member for blocking the electric power from a commercial AC power source 301. Reference characters 301L denote an electric power supply line through which AC current (which is the same in frequency as commercial power source) flows. The relay 303 is for turning on or off the electric power to be supplied to the heater 203 from the commercial AC power source 301.

A CPU 306 as a controlling section turns on a transistor 305 by outputting a relay driving signal to the transistor 305 through a resistor 304. An electric wire 213*b*, the protection element 214, an electric wire 213*a*, the driving coil portion 303*a* of the relay 303, and a DC power source 302 are serially connected to the transistor 305 in the listed order. As the transistor 305 is turned on, the relay 303 is turned on (closed), whereby it becomes possible for electric power to be supplied to the heat generating resistor layer 203*c* of the heater 203 from the commercial AC power source 301 through the relay 303. FIG. 4B is a drawing for showing the relationship between a DC power source 500, which generates DC voltage from the commercial AC power source 301, and the electric power supply line to the heater 203. The DC power source 500 outputs DC voltage Vcc, etc., for driving the relay 303, the CPU, etc.

In order to control the electric power to be supplied to the heater 203 according to the temperature of the heater 203, the electric power is supplied to the heater 203 by turning on or off a thyristor (which in this embodiment is triac: Triode AC switch) 307, which is a semiconductor switch. As a semiconductor switch, a field effect transistor (FET) may be employed other than a thyristor. The TRIAC 307 is connected to a photo TRIAC coupler 310, with the placement of resistors 308 and 309 between the TRIAC 307 and photo-TRIAC coupler 310. Each of the resistors 308 and 309 is a bias resistor for the TRIAC 307. The photo TRIAC coupler 310 is a device for ensuring that the primary side circuit and the secondary side circuit are isolated from each other, with reference to the transformer in the DC power source 500.

The CPU 306 turns on the transistor 312 by outputting a heater driving signal to the transistor 312 through the resistor 313. As the transistor 312 is turned on, the light emitting diode 310*b* of the photo TRIAC coupler 310 is made to emit light by the electric power from the DC voltage Vcc. The light emitted by the light emitting diode is caught by the photo coupler 310*a*, whereby the TRIAC 307 is turned on. The resistor 311, which is connected to the light emitting diode 310*b* is a resistor for controlling the electric current which flows to the light emitting diode 310*b*. The photo TRIAC coupler 310 is turned on or off by the transistor 312. The transistor 312 operates in response to the heater driving signal from the CPU 306.

To the CPU 306, voltage obtained by dividing the voltage Vcc by the resistors 314 and 315 is inputted. The amount of electrical resistance of the thermistor 314 changes in response to changes in temperature. Thus, the voltage inputted into the CPU 306 is proportional to the temperature of the heater 203. Incidentally, a voltage which is proportional in value to the temperature of the heater 203, is inputted into the CPU 306, in the form of a digital signal obtained by A/D conversion of the heater temperature.

As the heater 203 excessively increases in temperature, and therefore, the temperature of the protection element 214 becomes higher than a preset level, which is higher than the fixation level (target level), the protection element 214 opens (state of blocking) The protection element 214 is supplied with electric power from the DC power source 302 through the relay 303. Thus, as the protection element 214 opens, the relay 303 is turned off (closed state). Consequently, the connection between the protection element 214 and DC power source is broken. That is, as the heater 203 excessively increases in temperature, the protection element 214 blocks the electric power supply from the DC power source 302 to the driving coil portion 303*a*. Thus, the relay 303 is turned off, whereby the power supply from the commercial power supply 301 to the heater 203 is turned off. In this situation, even if a driving signal for turning on the relay 303 is outputted from the CPU 306, the relay 303 remains turned off. That is, the DC circuit, which makes electric current flow by way of the protection element 214, makes up a protection circuit which is independent from the CPU 306.

In this embodiment, the protection element 214 is connected to the electric power supply line of the DC power source 302 which drives the relay 303 (driving coil portion 303*a*). However, the protection element 214 may be connected to the electric power supply passage of the DC power source Vcc (connected to resistor 311) for driving the TRIAC 307. By the way, the power source Vcc, which is connected to the resistors 311 and 315, is also a DC power source.

(2-3) Thermal Fixing Operation of Fixing Device 112

Referring to FIGS. 2 and 3, the thermal fixing operation of the fixing device 112 is described. As the driving force of the motor 116, with which the main assembly 100A of the image forming apparatus 100 is provided, is transmitted to the pressure roller 201 through a gear G, the pressure roller 201 is rotated in the direction indicated by an arrow mark. Thus, the film 202 is rotated in the direction indicated by another arrow mark, by the rotation of the pressure roller 201, with the inward surface of the film 202 remaining in contact with the film bearing low-friction surface 203*b* of the heater 203.

As the heat generating resistor layer 203*c* of the heater 203 is supplied with the electric power from the commercial AC power source 301, it generates heat, thereby causing the heater 203 to quickly increase in temperature. The CPU 306 turns on or off the triac 307 to control the electric power supply to the heater 203, in order to maintain the temperature detected by the thermistor 314, which monitors the temperature of the heater 203, at the fixation level (target level).

A sheet P of recording medium, on which an unfixed toner image T is present, is conveyed through the nip N while remaining pinched by the pressure roller 201 and film 202, the heat from the heater 203 and the pressure in the nip N are applied to the unfixed toner image T. Consequently, the toner image T is thermally fixed to the surface of the sheet P.

(2-4) Structure of Protection Unit 400

Figure 5A:
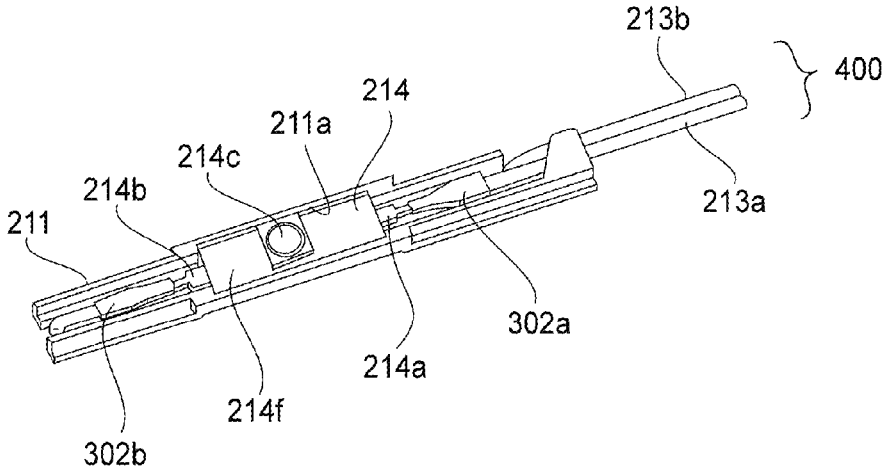
FIGS. 5A, 5B, 5C, 5D, 5E and 5F are perspective views of the protection unit of the fixing device in the first embodiment, and shows the general structure of the unit.
Figure 5B:
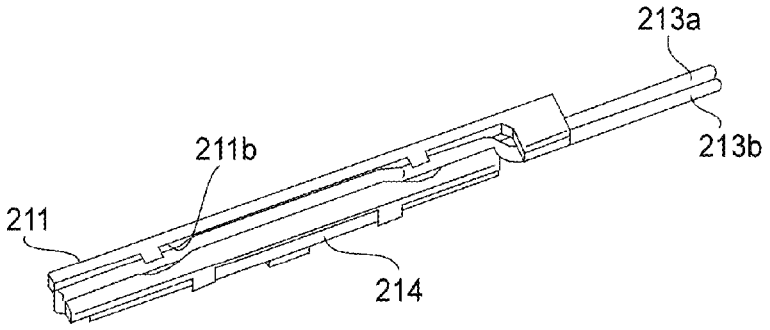
Figure 5C:
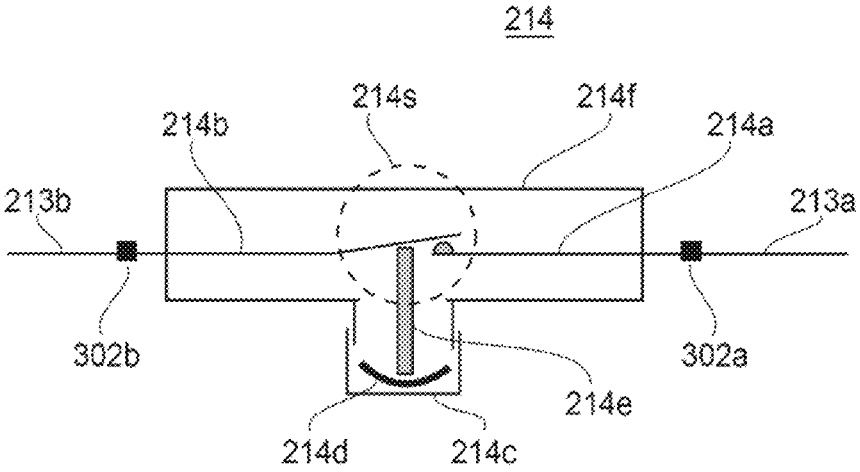
Figure 5D:
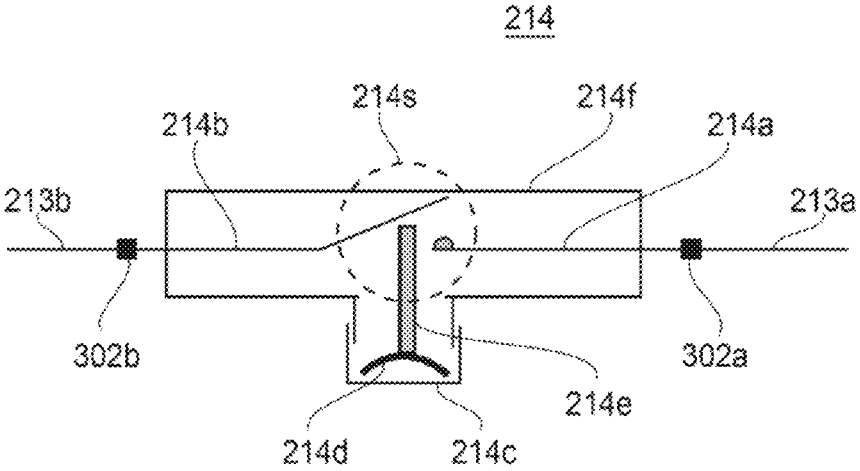

FIGS. 5A, 5B, 5C, 5D, 5E and 5F are perspective views of the protection unit 400, and show the general structure of the unit 400. FIG. 5A is a perspective view of the protection unit 400 shown in FIG. 2, as seen from the underside of the protection unit 400. FIG. 5B is a perspective view of the protection unit 400 shown in FIG. 2, as seen from the topside of the unit 400. FIGS. 5C and 5D are drawings for showing the operation of the internal components of the thermal switch. Further, FIGS. 5C and 5D are drawings for showing the operation of the protection element 214 when a thermal fuse is used as the protection element 214.

Referring to FIG. 5A, to the two terminals 214*a* and 214*b* of the protection element 214 held in the recess 211*a* of the holder 211, electrical wires 213*a* and 213*b* are connected. That is, the terminal 214*a* of the protection element 214 and the electric wire 213*a* are connected to each other with the use of a crimp terminal 302*a* to make an electrical connection between the terminal 214*a* and wire 213*a*. Referring to FIG. 5B, the electric wire 213*b* is extended along the holder 211 in such a manner that it extends on the top side of the holder 211 from the lengthwise end of the holder 211, which corresponds in position to the crimping terminal 302*b*, bends onto the bottom side of the holder 211, extends within the groove 211*b*, and extends, along with the electric wire 213*a*, from the lengthwise end of the holder 211, which corresponds in position to the crimping terminal 302*b*.

Reference characters 214*f* denote an electrically insulative casing, and reference characters 214*c* denote a metallic cap or cap portion. The cap portion 214*c* is put through a hole 206*c* with which the heater holder 206 is provided. There are provided terminals 214*a* and 214*b*, and also, the switching portion 214*s*, which reacts to the heat from the heater 203, in the electrically insulative casing (portions surrounded by broken line) 214*f*. When the temperature of the heater 203 is in the normal range, the switching portion 214*s* is on, that is, the terminals 214*a* and 214*b* are in contact with each other, as shown in FIG. 5C. As the temperature of the heater 203 rises into the abnormal range, the bimetal 214*d* bends (changes in shape) in a direction to push up the pin 214*e*. Thus, the pin 214*e* pushes up the terminal 214*b*. Consequently, the switching portion 214*s* is turned off. As a result, the relay 303 is turned off, and therefore, the electric power supply to the heater 203 is blocked.

Figure 5E:
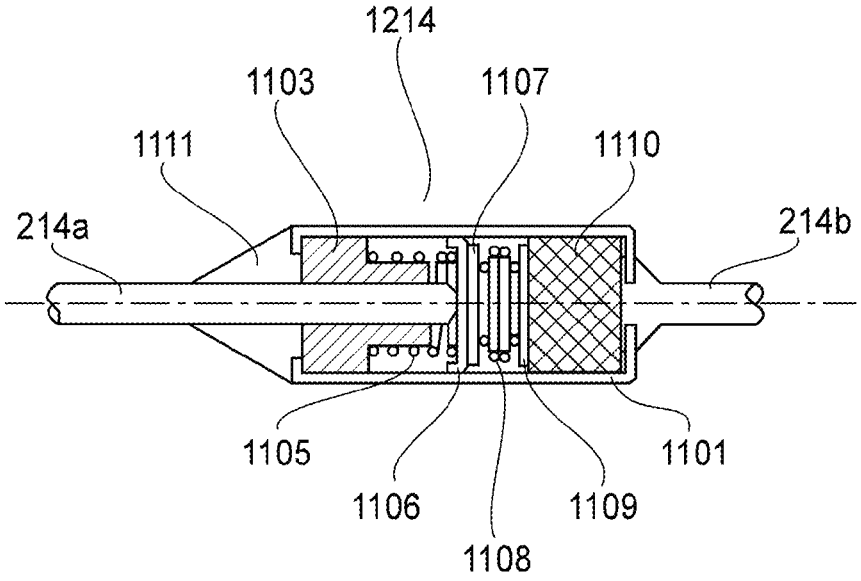
Figure 5F:
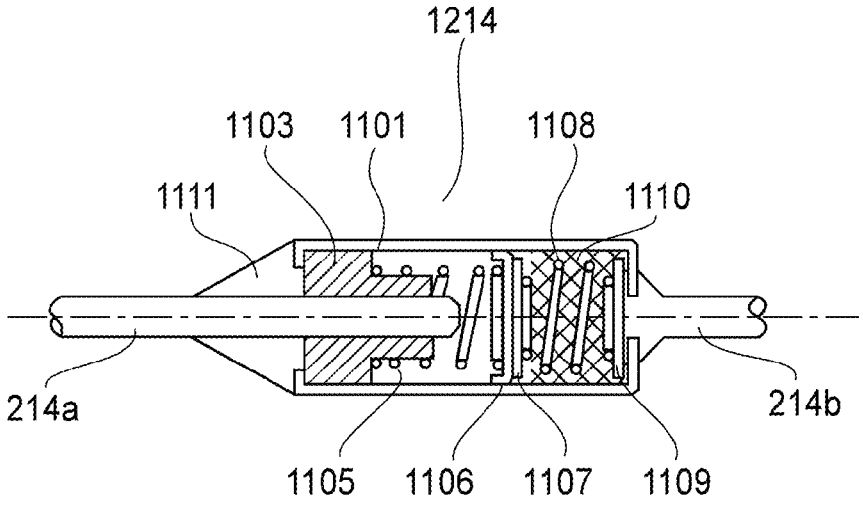

It may be a thermal fuse that is used as the protection element 214. FIGS. 5E and 5F are sectional views of the thermal fuse 214. FIG. 5E shows the state of the thermal fuse 214, in which electric power can be supplied to the heater 203 (thermal fuse is ON), whereas FIG. 5F shows the state of the thermal fuse 214, in which electric power cannot be supplied to the heater 203 (thermal fuse is OFF). Reference numeral 1101 denotes a metallic casing in which the thermal fuse is disposed. Reference characters 214*a* and 214*b* denote electrodes. The tip portion of the first electrode 214*a* is fitted with a cylindrical ceramic member 1103. The cylindrical member 1103 is inserted into one of the lengthwise end portions of the casing 1101, and then, the casing is crimped to electrically insulate the electrode 214*a* and casing 1101 from each other. The reference characters 214*b* denote the second electrode. One of the lengthwise end portions of the second electrode 214*b* is inserted into the opposite end portions of the casing 1101 from where the first electrode 214*a* is attached, and then, the lengthwise end of the casing 110 is crimped to provide an electrical connection between the electrode 214*b* and metallic casing 1101.

Reference numeral 1105 denotes the first spring; reference numeral 1106 denotes a movable electrode; reference numeral 1107 denotes the first disc; reference numeral 1108 denotes the second spring; reference numeral 1109 denotes the second disc; and a reference numeral 1110 denotes a pellet formed of an organic substance. The first spring 1105 is disposed compressed between the ceramic cylindrical member 1103 and the movable electrode 1106, and the second spring 1108 is disposed compressed between the discs 1107 and 1109. The amount of resiliency of the second spring 1103 is made greater than the resiliency amount of the first spring 1107. Referring to FIG. 5E, when the thermal fuse 214 is in the normal state, the first spring 1105 remains compressed between the movable electrode 1106 and the cylindrical member 1103. Thus, the movable electrode 1106 remains pressed upon the tip of the first electrode 214*a*, by the expansive force of the second spring 1108 between the discs 1107 and 1109, maintaining thereby an electrical connection between movable electrode 1106 and the first electrode 214*a*. Further, the pellet 1110 is in contact with the corresponding end of the second electrode 214*b*, playing thereby the role of a spacer between the disc 1109 and the second electrode 214*b*. The movable electrode 1106 is in contact with the inward surface of the metallic casing 1101, by its peripheral edge. Thus, the movable electrode 1106 is allowed to freely move in the casing 1101 in the direction of the axial line of the casing 1101 while maintaining an electrical connection with the casing 1101.

When the thermal switch 214 is in the state shown in FIG. 5E, DC current flows through the first electrode 214*a*, the movable electrode 1106 which remains pressed upon the tip of the first electrode 214*a*, the metallic casing 1101, which is electrically connected to the movable electrode 1106, and the second electrode 214*b*, in the listed order. A reference numeral 1111 denotes a resinous component provided to keep the casing 1101 airtightly sealed. This thermal fuse 214 is kept in contact with the heater 203. Thus, the heat from the heater 203 is transferred to the pellet 1110 in the metallic casing 1101 through the casing 1101, etc.

As long as the temperature of the pellet 1110 remains below a preset reaction level, the thermal fuse 214 remains in the state shown in FIG. 5E, and therefore, it keeps the DC circuit intact. On the other hand, as the heater 203 excessively increases in temperature, the pellet 1110 melts and liquefies, or sublimates and disappears. Thus, the second spring 1108 is pushed toward the second electrode 214*b* by the expansive force of the first spring 1105, thereby causing the movable electrode 1106 to separate from the tip of the first electrode 214*a*. Consequently, the DC circuit is turned off (broken). As described above, the thermal switch 214 also has the switching portion 214*s*, which reacts to the heat it receives from the heater 203. As the DC circuit is turned off (broken), the relay 303 is turned off. Thus, the electric power supply to the heater 203 is blocked.

In this embodiment, the protection element 214 is connected to the DC circuit. Therefore, it is possible to use the electric wire for the DC power source 302 (which has a smaller diameter than AWG19, for example), as the electric wires 213*a* and 213*b* to be connected to the protection element 214, instead of the electric wire for the commercial AC power source 301 (which is greater in diameter than AWG20, for example). By the way, "AWG" is an abbreviation of "American Wire Gauge".

According to this embodiment, the fixing device 112 is structured so that its protection element 214 is connected to the DC power source. Therefore, it is possible to use electric wire for the DC power source 302, which is smaller in diameter than the electric wire for the commercial AC power source 301, as the electric wires 213*a* and 213*b* for the protection element 214. In other words, it is possible to reduce the space occupied by the electric wires in the metallic stay 209. Thus, it is possible to reduce the stay 209 in size. Therefore, it is possible to reduce the film 202 in diameter. That is, it is possible to reduce in size, the film unit 200, which is an effective means for improving a fixing device in FPOT.

Since it is possible to use the electric wire for the DC power source 302, which is smaller in diameter than the electric wire for the commercial AC power source 301, the fixing device 112 in this embodiment requires a smaller space for bending the electric wire from the top side of holder 211 onto the bottom side, at one of the lengthwise ends of the holder 211 than any fixing device in accordance with the prior art. Therefore, it makes unnecessary the electric wire holding member, which is different from the holder 211, for routing the electric wire for the commercial AC power source. Since this embodiment makes the electric wire holding member unnecessary, it has also an effect that it affords more latitude in terms of the positioning of such components as the protection unit 400, thermistor 314, etc.

Embodiment 2

Figure 6:
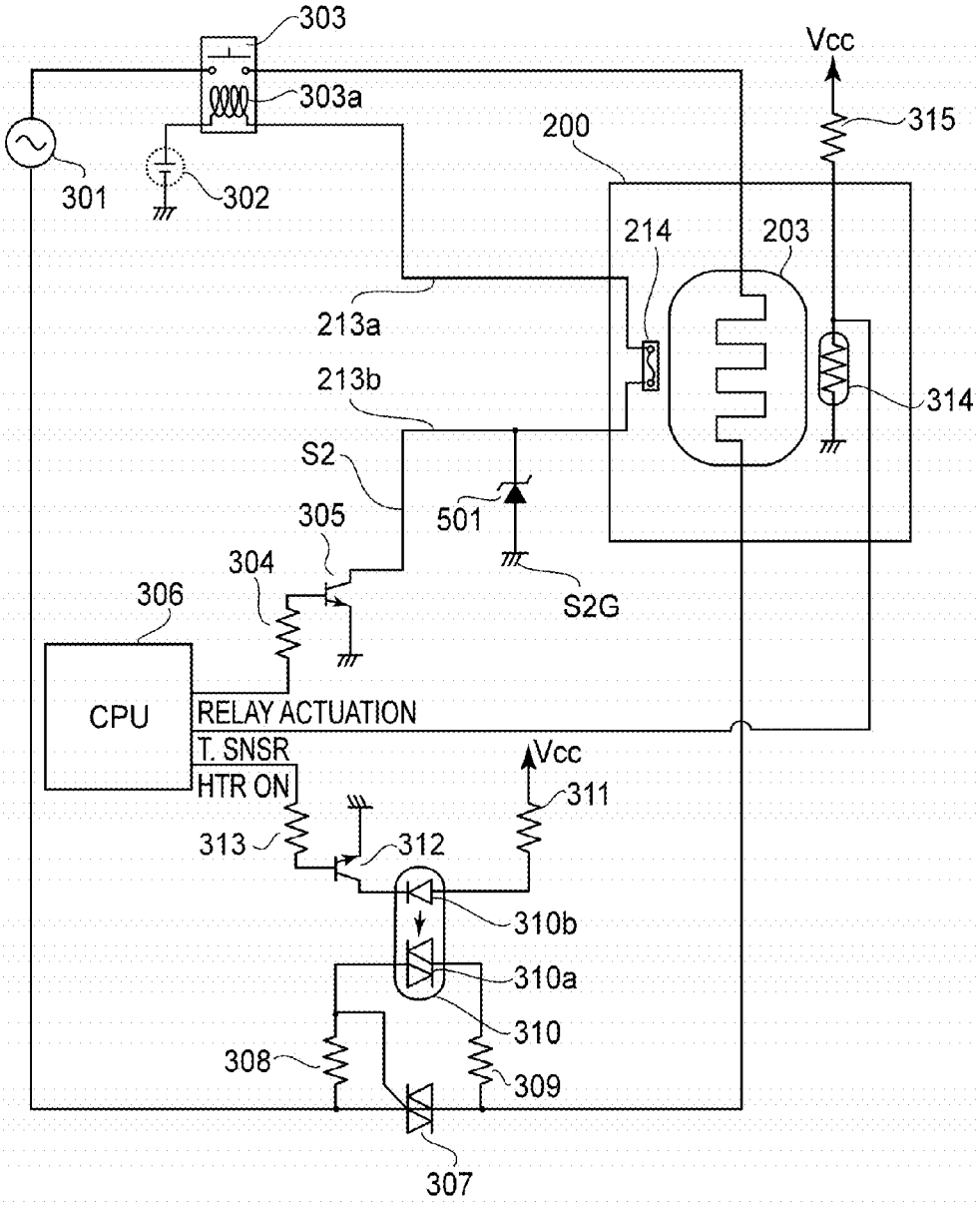
FIG. 6 is a drawing of the heater driving circuit of the fixing device in the second embodiment of the present invention.

Next, another embodiment of the fixing device 112 is described. The fixing device 112 in this embodiment is the same in structure as the fixing device 112 in the first embodiment, except that a surge protection element, as a surge protection member, is inserted in the DC circuit, which includes the protection element 214. FIG. 6 shows the structure of the heater driving circuit of the fixing device 112 in this embodiment.

The fixing device 112 in this embodiment has its protection element 214 on the inward side of the film 202, as does the fixing device 112 in the first embodiment. Its protection element 214 is serially connected with the DC power source of the secondary side. With the protection element 214 being connected to the secondary side DC power source 302, the distance between the protection element 214 and the heater 203 has to be greater than that in a conventionally structured fixing device (protection element is directly connected to commercial AC power source), for the sake of ensuring that the device is electrically insulated.

Referring to FIG. 6, in this embodiment, therefore, a Zener diode 501 is inserted, as a surge protection element, between the primary side line S2, which connects the protection element 214 to the secondary side DC power source 302, and the secondary side ground GNDS2G of this secondary side line. By the way, instead of the Zener diode 501, a varistor, which is capable of functioning in a similar manner to the Zener diode 501, may be inserted. With the insertion of the Zener diode 501, if the fixing device 112 is subjected to abnormally high voltage (voltage surge) attributable to lightening or the like through the commercial AC power source 301, and the protection element 214 connected to the secondary side DC power source 302, it is possible to shunt the high voltage to the secondary side GND through the Zener diode 501.

In FIG. 6, the Zener diode 501 is connected to the secondary side line S2, between the protection element 214 and transistor 305. However, it may be inserted between the secondary side DC voltage 302 and the protection element 214.

According to this embodiment, the electric wire for the DC power source 302, which is smaller in diameter than the electric wire for the AC power source 301, can be used as the electric wires 213*a* and 213*b* for the protection element 214, as in the first embodiment. Therefore, the fixing device 112 in this embodiment can offer the same effects as the fixing device 112 in the first embodiment. Further, in the case of the fixing device 112 in this embodiment, the components on the secondary side, such as the CPU 306, transistor 305, etc., can be prevented from being destroyed by the high voltage. In other words, this embodiment can accomplish two objectives. That is, not only can this embodiment reduce the film unit 200 of the fixing device 112 in size, but also, it is effective to prevent the secondary side components of the heater driving circuit from being damaged by the high voltage.

Embodiment 3

Figure 7:
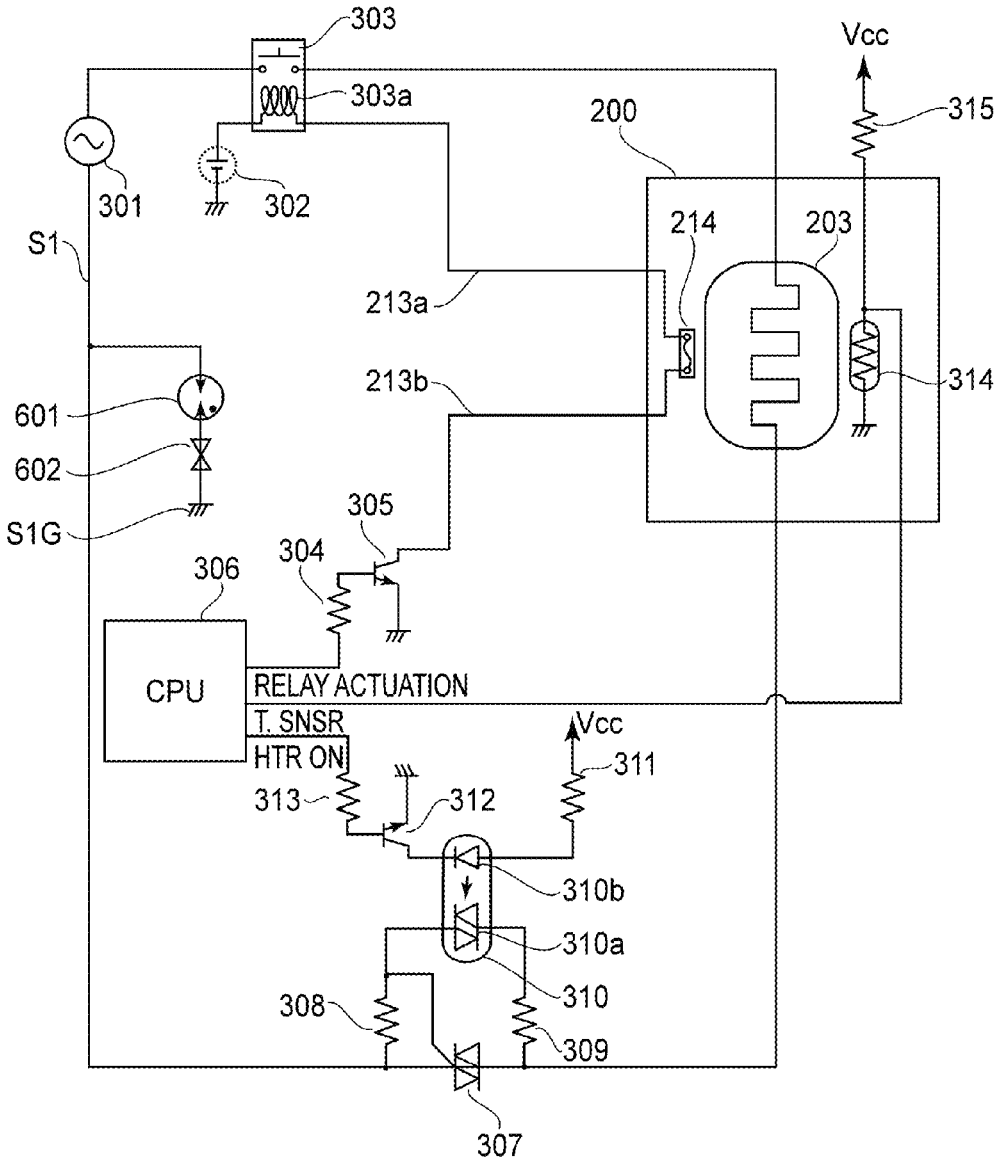
FIG. 7 is a drawing of the heater driving circuit of the fixing device in the third embodiment of the present invention.

Next, the fixing device 112 in another embodiment of the present invention is described. The fixing device 112 in this embodiment is the same in structure as the fixing device 112 in the first embodiment, except that a surge protection element is inserted, as a surge protecting member, in the primary side line of the heater driving circuit. FIG. 7 shows the structure of the heater driving circuit of the fixing device 112 in this embodiment.

In the case of the fixing device 112 in this embodiment, the protection element 214 is disposed within the film unit 200, and the protection element 214 is serially connected to the DC power source 302, as in the first embodiment. As stated in the description of the second embodiment, connecting the protection element 214 to the DC power source 302 requires a greater distance between the protection element 214 and heater 203 than in the case of a conventionally structured fixing device, for the sake of ensuring that the device is electrically insulated.

Referring to FIG. 7, in this embodiment, therefore, a gas arrester 601 and a varistor 602 are serially inserted between the primary side line S1, which connects the heater 203 to the AC power source 301, and the primary side GNDS1G of this primary side line. Here, instead of the gas arrester 601 and varistor 602, a lightening conductor, which is similar in function to these components, may be inserted. With the insertion of the gas arrester and varistor 602, as abnormally high voltage, such as the one attributable to lightening, enters through the commercial AC power source 301, it can be shunted to the primary side ground GND through the gas arrester 601.

In the case of the circuit shown in FIG. 7, the gas arrester 601 and varistor 602 are serially inserted between the primary side line S1, which connects heater 203 to the commercial AC power source 301, and the primary side ground GND of this primary side line. However, they may be inserted between the commercial AC power source 301 and the relay 303.

According to this embodiment, the electric wire for the DC power source 302, which is smaller in diameter than the electric wire for the commercial AC power source 301, can be used as the electric wires 213*a* and 213*b* for the protection element 214 of the fixing device 112. Thus, this embodiment can provide the same effects as the first embodiment. Further, according to this embodiment, it is possible to prevent the components, such as the triac 307 on the primary side, from being damaged by the high voltage, by the gas arrester 601 and varistor 602 inserted between the primary side line S1 and the primary side GNDS1G (between primary side GNDs). In other words, this embodiment can deliver two effects. That is, not only can this embodiment reduce in size the film unit 200 of the fixing device 112, but also, it is effective to prevent the primary side components of the heater driving circuit from being damaged by the high voltage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 237910/2013 filed Nov. 18, 2013, which is hereby incorporated by reference.

What is claimed is:

1. An image forming apparatus comprising:

a fixing portion configured to heat and fix an unfixed image formed on a recording material, said fixing portion including a cylindrical film, a heater disposed in an inside space of said film, and a protection element, having a switch portion actuatable by heat from said heater, configured to shut off electric power supplied to said heater;

a DC voltage source configured to generate a DC voltage from a commercial AC voltage source;

a controller configured to control an electric power supply to said heater, a relay connected in an electric power supply line to said heater, wherein said protection element is disposed in the inside space of said film, wherein said protection element is connected in a DC circuit operable by said DC voltage source and is connected in said DC circuit extending from said controller to said relay, and wherein when said switch portion is rendered off, said relay is rendered off to shut off the electric power supply to said heater.

2. An apparatus according to claim 1, further comprising a temperature detecting element, connected in the DC circuit openable by said DC voltage source, configured to detect a temperature of said heater, a semiconductor switch connected in the electric power supply line to said heater, wherein said controller controls said semiconductor switch in accordance with the temperature detected by said temperature detecting element.

3. An apparatus according to claim 2, wherein said semiconductor switch is a thyristor or an electric field effect transistor, and said temperature detecting element is a thermistor.

4. An apparatus according to claim 1, wherein said protection element is a thermo-switch or a temperature fuse.

5. An apparatus according to claim 1, further comprising a surge protection element connected between said DC circuit and a ground.

6. An apparatus according to claim 5, wherein said surge protection element is a Zener diode or a varistor.

7. An apparatus according to claim 1, further comprising a surge protection element connected between an electric power supply line to said heater and a ground.

8. An apparatus according to claim 7, wherein said surge protection element includes a gas arrester and a varistor connected in series.

9. An apparatus according to claim 1, wherein said heater is in contact with an inner surface of said film.

10. An apparatus according to claim 9, further comprising a stay, having a U-shaped cross-section, configured to urge said heater toward the inner surface of said film, wherein said protection element is disposed in an inside space of the U-shape.

11. An image forming apparatus comprising:

a fixing portion configured to heat and fix an unfixed image formed on a recording material, said fixing portion including a cylindrical film, a heater disposed in an inside space of said film, and a protection element, having a switch portion actuatable by heat from said heater, configured to shut off electric power supplied to said heater;

a DC voltage source configured to generate a DC voltage from commercial AC voltage source; and a semiconductor switch connected in an electric power supply line to said heater, wherein said protection element is disposed in the inside space of said film and is connected in a DC circuit operable by said DC voltage source, and wherein when said switch portion is rendered off, said semiconductor switch is rendered off to shut off the electric power supply to said heater.

12. An apparatus according to claim 11, wherein said semiconductor switch is a thyristor or electric field effect transistor.

13. An apparatus according to claim 11, wherein said protection element is a thermo-switch or a temperature fuse.

14. An apparatus according to claim 11, wherein said heater is in contact with an inner surface of said film.

15. An apparatus according to claim 14, further comprising a stay, having a U-shaped cross-section, configured to urge said heater toward the inner surface of said film, wherein said protection element is disposed in an inside space of the U-shape.

16. An image forming apparatus comprising:

a fixing portion configured to heat and fix an unfixed image formed on a recording material, said fixing portion including a cylindrical film, a heater disposed in an inside space of said film, and a protection element, having a switch portion actuatable by heat from said heater, configured to shut off electric power supplied to said heater;

a DC voltage source for generating a DC voltage from commercial AC voltage source, wherein said protection element is disposed in the inside space of said film and is connected in a DC circuit operable by said DC voltage source; and a surge protection element connected between said DC circuit and a ground, wherein when said switch portion is rendered off, the electric power supply to said heater is shut off.

17. An apparatus according to claim 16, wherein said protection element is a thermo-switch or a temperature fuse.

18. An apparatus according to claim 16, wherein said surge protection element is a Zener diode or a varistor.

19. An apparatus according to claim 16, wherein said heater is in contact with an inner surface of said film.

20. An apparatus according to claim 19, further comprising a stay, having a U-shaped cross-section, configured to urge said heater toward the inner surface of said film, wherein said protection element is disposed in an inside space of the U-shape.

21. An image forming apparatus comprising:

a fixing portion configured to heat and fix an unfixed image formed on a recording material, said fixing portion including a cylindrical film, a heater disposed in an inside space of said film, and a protection element, having a switch portion actuatable by heat from said heater, configured to shut off electric power supplied to said heater;

a DC voltage source for generating a DC voltage from commercial AC voltage source; and a surge protection element connected between an electric power supply line to said heater and a ground, wherein said protection element is disposed in the inside space of said film and is connected in a DC circuit operable by said DC voltage source, wherein when said switch portion is rendered off, the electric power supply to said heater is shut off.

22. An apparatus according to claim 21, wherein said protection element is a thermo-switch or a temperature fuse.

23. An apparatus according to claim 21, wherein said surge protection element includes a gas arrester and a varistor connected in series.

24. An apparatus according to claim 21, wherein said heater is in contact with an inner surface of said film.

25. An apparatus according to claim 24, further comprising a stay, having a U-shaped cross-section, configured to urge said heater toward the inner surface of said film, wherein said protection element is disposed in an inside space of the U-shape.

* * * * *